US012607004B2

(12) United States Patent
Peltomäki et al.

(10) Patent No.: US 12,607,004 B2
(45) Date of Patent: Apr. 21, 2026

(54) UNDERGROUND ROOM ARRANGEMENT

(71) Applicant: PELTOMÄEN RAKENNUS OY, Vaskivesi (FI)

(72) Inventors: Aki Peltomäki, Vaskivesi (FI); Aku Peltomäki, Vaskivesi (FI)

(73) Assignee: PELTOMÄEN RAKENNUS OY, Vaskivesi (FI)

( * ) Notice: Subject to any disclaimer, the term of this patent is extended or adjusted under 35 U.S.C. 154(b) by 227 days.

(21) Appl. No.: 18/262,352

(22) PCT Filed: Feb. 2, 2022

(86) PCT No.: PCT/FI2022/050066
§ 371 (c)(1),
(2) Date: Jul. 20, 2023

(87) PCT Pub. No.: WO2022/167727
PCT Pub. Date: Aug. 11, 2022

(65) Prior Publication Data

US 2024/0093478 A1 Mar. 21, 2024

(30) Foreign Application Priority Data

Feb. 4, 2021 (FI) ..... 20215123

(51) Int. Cl.
*E04H 9/12* (2006.01)
*E04B 1/00* (2006.01)

(52) U.S. Cl.
CPC ..... *E04B 1/0015* (2013.01); *E04H 9/12* (2013.01)

(58) Field of Classification Search
CPC ..... E04B 1/0007; E04B 1/0015; E04H 9/08; E04H 9/12; E02D 29/045
See application file for complete search history.

(56) References Cited

U.S. PATENT DOCUMENTS 2,871,802 A * 2/1959 Fishler ..... E04H 9/12 D25/36
3,038,565 A * 6/1962 Bruce ..... E04H 9/12 D25/36
3,049,835 A * 8/1962 Sundstrum ..... E04H 9/12 D25/36
3,093,056 A * 6/1963 Rosenfeld ..... E04H 9/12 454/253

(Continued)

FOREIGN PATENT DOCUMENTS

AU 2021102662 A4 * 7/2021 ..... E02D 29/045
CN 104847001 A 8/2015

(Continued)

OTHER PUBLICATIONS

Finnish Patent and Registration Office, Office Action Issued in Application No. 20215123, Apr. 29, 2021, 6 pages.

(Continued)

*Primary Examiner* — Kyle J. Walraed-Sullivan
(74) *Attorney, Agent, or Firm* — McCoy Russell LLP

(57) ABSTRACT

An underground room arrangement, comprising a structure surrounding a room, the structure comprising a plastic tube and plastic end walls, wherein the plastic end walls are arranged to close the plastic tube so that inner surfaces of the plastic tube and the plastic end walls are towards the room.

12 Claims, 4 Drawing Sheets

(56) References Cited

U.S. PATENT DOCUMENTS

| | | | | | |
|---|---|---|---|---|---|
| 3,093,097 | A * | 6/1963 | Rosenfeld | E04H 9/12 109/1 S |
| 3,118,401 | A * | 1/1964 | Platt | E04H 9/10 135/93 |
| 3,138,124 | A * | 6/1964 | Baier | E04H 9/12 109/1 S |
| 3,159,117 | A * | 12/1964 | Rosenfeld | E04H 9/12 4/434 |
| 3,380,147 | A * | 4/1968 | Mcdonald | E04H 7/30 52/247 |
| 3,464,374 | A * | 9/1969 | Basler | E04H 9/12 109/1 R |
| 4,805,360 | A * | 2/1989 | Kuehnl | E04H 9/12 52/169.1 |
| 5,749,181 | A * | 5/1998 | Bauman | E04H 9/12 52/302.1 |
| 5,829,208 | A * | 11/1998 | Townley | E04H 9/12 52/169.1 |
| 6,385,920 | B1 * | 5/2002 | Chandler | E04H 9/12 52/169.7 |
| 6,434,896 | B1 * | 8/2002 | Mitchell | E04H 9/14 52/80.2 |
| 9,217,244 | B2 | 12/2015 | Early et al. | |
| 10,486,330 | B2 | 11/2019 | Giles | |
| 2015/0009621 | A1 * | 1/2015 | Baldinger | H05K 7/20781 361/679.48 |
| 2019/0112778 | A1 | 4/2019 | Gilbert | |
| 2024/0093458 | A1 * | 3/2024 | Carmichael | E04H 9/14 |

FOREIGN PATENT DOCUMENTS

| | | | | | |
|---|---|---|---|---|---|
| DE | 202008009164 | U1 | | 12/2008 | |
| DE | 102012000361 | A1 | * | 7/2013 | H05K 7/20745 |
| EP | 1707697 | A1 | | 10/2006 | |
| FI | 113837 | B | | 6/2004 | |
| GB | 2075570 | A | * | 11/1981 | E04H 9/12 |
| GB | 2081333 | A | * | 2/1982 | E04H 9/12 |
| GB | 2081766 | A | * | 2/1982 | E04H 9/12 |
| GB | 2301848 | A | | 12/1996 | |
| JP | 2004183272 | A | | 7/2004 | |
| JP | 4984118 | B2 | | 7/2012 | |
| JP | 2018178706 | A | | 11/2018 | |
| WO | 0218279 | A1 | | 3/2002 | |
| WO | 2005024147 | A1 | | 3/2005 | |
| WO | 2011089314 | A1 | | 7/2011 | |
| WO | 2012001610 | A2 | | 1/2012 | |
| WO | 2014027140 | A1 | | 2/2014 | |
| WO | 2018042082 | A2 | | 3/2018 | |
| WO | 2020096530 | A1 | | 5/2020 | |

OTHER PUBLICATIONS

Finnish Patent and Registration Office, Search Report Issued in Application No. 20215123, Apr. 29, 2021, 6 pages.

Finnish Patent and Registration Office, Office Action Issued in Application No. 20215123, Sep. 17, 2021, 4 pages.

ISA European Patent Office, International Search Report Issued in Application No. PCT/FI2022/050066, Mar. 3, 2022, WIPO, 5 pages.

ISA European Patent Office, Written Opinion of the International Searching Authority Issued in Application No. PCT/FI2022/050066, Mar. 3, 2022, WIPO, 5 pages.

Finnish Patent and Registration Office, Office Action Issued in Application No. 20215123, Nov. 2, 2022, 4 pages.

"Pipe World—Wastewater Treatment in Rural Areas," Weholite Website, Available Online at https://www.weholite.com/documents/220153/256774/pipeworld-07.pdf/c007a503-4056-46d2-8eb2-f6f426079212, Jan. 2007, 24 pages.

"Pipe World—The Uponor Infra Customer Magazine," No. 2, Feb. 2015, 24 pages.

"Uponor turns 100 years old! From a carpentry workshop to an international listed company: the 100th anniversary of Uponor," Talotekniikka-Lehti Website, Available Online at https://talotekniikka-lehti.fi/uponor-tayttaa-100-vuotta/, Jan. 24, 2018, 13 pages. (Submitted with Machine Translation).

"Webinar | Weholite Structural Polyethylene Systems," YouTube Website, Available Online at https://www.youtube.com/watch?v=N321_cJzIAQ, Jun. 13, 2018, 1 page.

"Pumping Stations," Internet Archive Wayback Machine Website, Available Online at https://web.archive.org/web/20210918193830/https://www.weholite.co.uk/products/pumping-stations/, Available as Early as Oct. 31, 2018, 1 page.

"Weholite Wine Celler 2400," UPONOR, Org. No. 221118-1, Nov. 22, 2018, 1 page.

Uponor100, IMG_20180706_135801.jpg, Date Taken by Metadata Jul. 6, 2018, 1 page. (See Notice of Opposition Issed in Application No. 20215123 for Explanation of Relevance).

Uponor100, IMG_20180817_232252.jpg, Date Taken by Metadata Aug. 17, 2018, 1 page. (See Notice of Opposition Issed in Application No. 20215123 for Explanation of Relevance).

Finnish Patent and Registration Office, Notice of Opposition Issued in Application No. 20215123, Mar. 20, 2025, 18 pages.

* cited by examiner

UNDERGROUND ROOM ARRANGEMENT

CROSS REFERENCE TO RELATED APPLICATIONS

The present application is a U.S. National Phase of International Application No. PCT/FI2022/050066 entitled "UNDERGROUND ROOM ARRANGEMENT," and filed on Feb. 2, 2022. International Application No. PCT/FI2022/050066 claims priority to Finnish Patent Application No. 20215123 filed on Feb. 4, 2021. The entire contents of each of the above-listed applications are hereby incorporated by reference for all purposes.

TECHNICAL FIELD

The invention relates to an underground room arrangement.

A problem with known underground rooms is that their building at the building site is burdensome.

BACKGROUND AND SUMMARY

Viewed from a first aspect, there can be provided an underground room arrangement, comprising a structure surrounding a room, the structure comprising a plastic tube and plastic end walls, wherein the plastic end walls are arranged to close the plastic tube so that inner surfaces (2) of the plastic tube and the plastic end walls are towards the room.

Thereby an underground room arrangement that is quick and easy to make ready for use at the building site may be achieved.

The arrangement and the method are characterised by what is stated in the independent claims. Some other embodiments are characterised by what is stated in the other claims. Inventive embodiments are also disclosed in the specification and drawings of this patent application. The inventive content of the patent application may also be defined in other ways than defined in the following claims. The inventive content may also be formed of several separate inventions, especially if the invention is examined in the light of expressed or implicit sub-tasks or in view of obtained benefits or benefit groups. Some of the definitions contained in the following claims may then be unnecessary in view of the separate inventive ideas. Features of the different embodiments of the invention may, within the scope of the basic inventive idea, be applied to other embodiments.

In one embodiment, the dimension of the room in the axial direction of the plastic tube is created by one and only one plastic tube. An advantage is that a simple structure with minimum seams and joints may be achieved.

In one embodiment, the wall of the plastic tube comprises a hollow. An advantage is that the weight of the plastic tube is low and that a functional element can be arranged in the hollow.

In one embodiment, the wall of the plastic tube comprises a spiral hollow spiralling in the wall in the axial direction of the plastic tube. An advantage is that a very light but still stiff structure of the arrangement may be achieved.

In one embodiment, the wall of the plastic tube is construed from at least one spiralling hollow pipe. An advantage is that a stiff but light structure of the arrangement may be achieved.

In one embodiment, a functional element is arranged or integrated in the hollow. An advantage is that the functional element is safe in the structure of the plastic tube.

In one embodiment, the functional element comprises at least one of the following elements: a ventilation duct, an electric cable, a water pipeline, a drainpipe. An advantage is that element(s) necessary for the use of the room can be arranged in safe in the structure of the plastic tube.

In one embodiment, the axial direction of the plastic tube is arranged to create the height of the room, and wherein one of the plastic end walls is arranged as a cover structure to cover the room from above and another of the plastic end walls is arranged as a bottom element, and wherein the arrangement further comprises a passage arranged in at least one of the following: the cover structure and/or the wall of the plastic tube. An advantage is that the space inside the arrangement can be utilized effectively as a room space.

In one embodiment, the axial direction of the plastic tube is arranged to create a length of the room, wherein the plastic tube is arranged to cover the room from above, below and two sides, the arrangement further comprising a passage arranged in at least one of: the wall of the plastic tube and/or one of the end walls. An advantage is that it is simple to produce a room having a significant length.

In one embodiment, the passage is provided with a sleeve extending away from the room. An advantage is that the plastic tube can be arranged deeper under the ground level.

In one embodiment, the arrangement comprises a staircase arranged to extend from the room to the passage. An advantage is that entry and exit of the room is simple and safe.

In one embodiment, the plastic tube has a round or roundish cross-section. An advantage is that the structure is very rigid and stands earth pressure well.

In one embodiment, the plastic tube has a polygonal cross-section. An advantage is that the shape of a traditional room may be achieved.

In one embodiment, the plastic end walls are attached to the plastic tube by a watertight manner. An advantage is that intruding of water in the room may be avoided.

BRIEF DESCRIPTION OF FIGURES

Some embodiments illustrating the present disclosure are described in more detail in the attached drawings, in which.

In the figures, some embodiments are shown simplified for the sake of clarity. Similar parts are marked with the same reference numbers in the figures.

DETAILED DESCRIPTION

Figure 1:
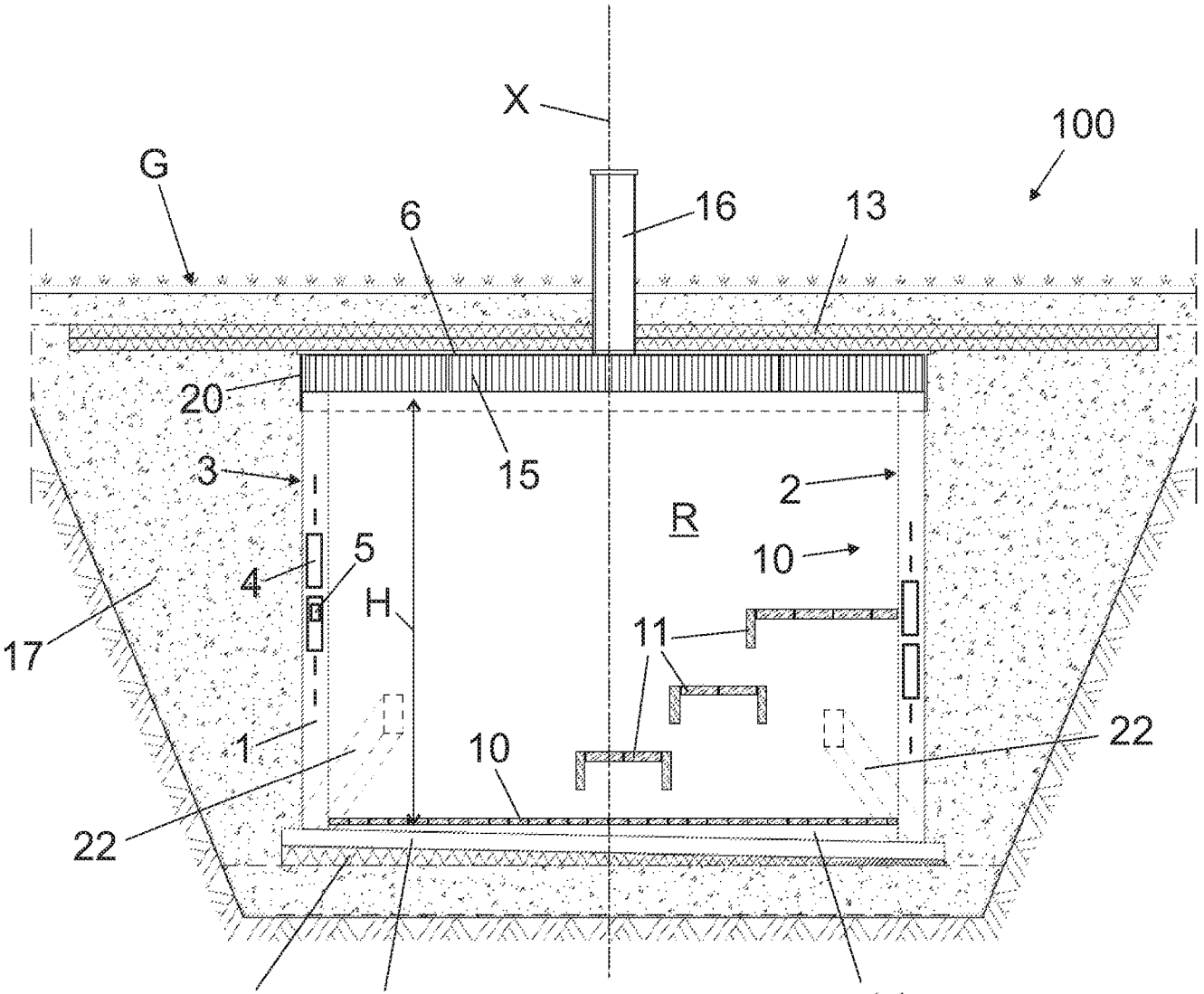
FIG. 1 is a schematic side view of an arrangement in partial cross-section.
Figure 2:
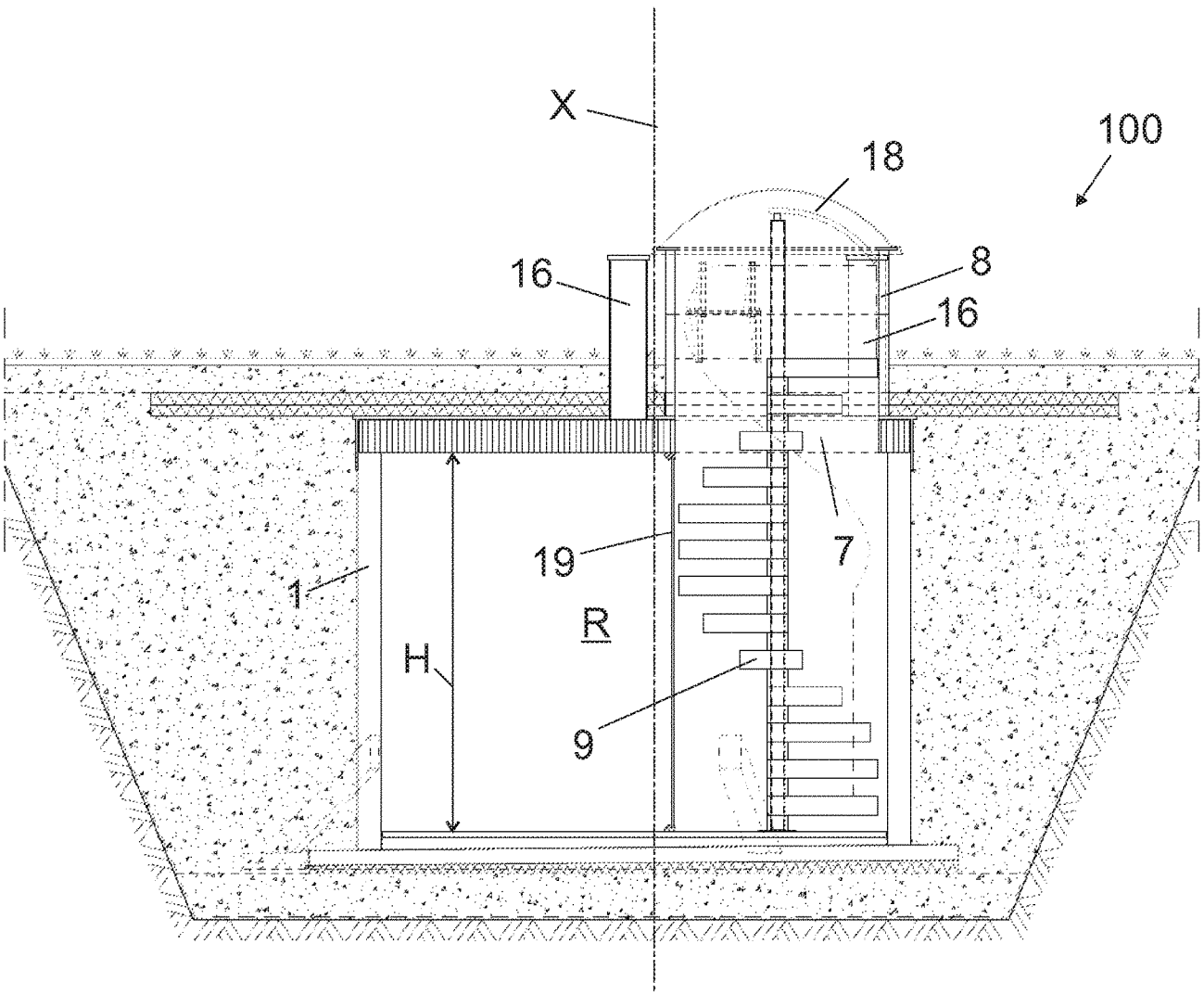
FIG. 2 is another schematic side view of the arrangement shown in FIG. 1.
Figure 3:
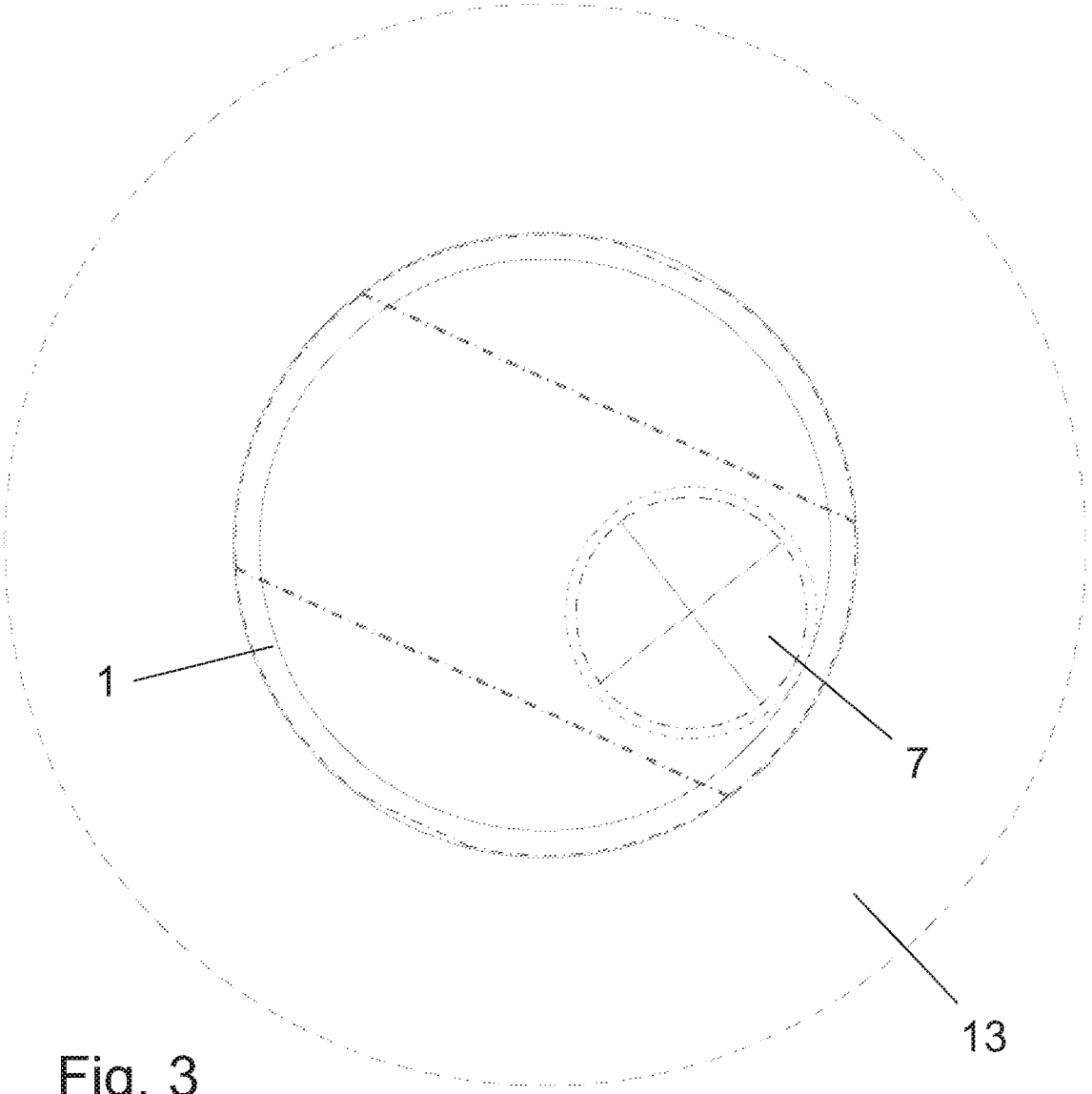
FIG. 3 is a schematic top view of the arrangement shown in FIG. 1, FIGS. 4*a* and 4*b* are showing further embodiments of a plastic tube.

FIG. 1 is a schematic side view of an underground room arrangement in partial cross-section, FIG. 2 is another schematic side view of the arrangement shown in FIG. 1, and FIG. 3 is a schematic top view of the arrangement shown in FIG. 1.

The arrangement 100 comprises a structure construed of a plastic tube 1 or pipe. In this embodiment, the plastic tube 1 is round. The plastic tube surrounds a room R so that an inner surface 2 of the plastic tube is towards the room R, and an outer surface 3 of the plastic tube is away from the room.

The axial direction X of the plastic tube is arranged to create the height H of the room, i.e. the plastic tube is arranged in a vertical position.

In one embodiment, the arrangement 100 is arranged below the ground level, except two ventilation ducts 16 and a passageway to the room. Regarding the installation and the intended use of the room, there may be some other amount of ventilation ducts 16, such as zero, one, three or more than three. The passageway 16 may as well comprise a ventilation arrangement. In other embodiments, there may be further elements or parts extending to or above the ground level, such as a periscope, an emergency exit, a skykight.

The arrangement 100 may be arranged in a pit excavated in the ground. The rest of the pit (if any) can be filled with e.g. backfill.

In one embodiment, such as shown in FIG. 1, the wall of the plastic tube 1 comprises at least one hollow 4. The hollow 4 may be e.g. a spiral-shaped hollow spiralling in the wall in the axial direction X of the plastic tube 1. This kind of hollow may be a result of manufacturing the plastic tube 1 from a plastic pipe having a generally rectangular cross section that is wound around a cylindrical surface or mandrel to produce a succession of turns of the strip which laterally abut or overlap each other. The abutting or overlapping turns are joined together, thereby forming a helically or spirally wound tube.

In one embodiment, the plastic tube 1 comprises just one hollow that is spiralling all along the wall.

In one embodiment, there are plurality of spiralling hollows in the wall of the plastic tube 1, for instance two or three separate hollows.

In one embodiment, the wall of the plastic tube 1 comprises one or more lengthwise hollow(s), i.e. the hollow is at least essentially parallel with the axial direction X of the plastic tube 1.

In one embodiment, the wall of the plastic tube 1 comprises one or more circumferential hollow(s), i.e. the hollow is at least essentially perpendicular to the axial direction X of the plastic tube 1.

The plurality of hollows 4 may be arranged in the wall such that there is just one hollow in the thickness direction of the wall—as shown in FIG. 1. Alternatively, there may be two or even more hollows in the thickness direction of the wall side by side.

The cross-section of the hollow(s) 4 may be e.g. rectangular as shown in FIG. 1. However, also another polygonal as well as round or roundish cross-section is possible.

In one embodiment, the outer and the inner surfaces 2, 3 are smooth. In another embodiments, at least one of the outer and the inner surfaces 2, 3 is corrugated. For instance, the inner surface 3 is smooth and the outer surface 2 is corrugated.

In another embodiment, the wall of the plastic tube 1 is solid.

As described above, the plastic tube is arranged in a vertical position. In one embodiment, such as shown in FIG. 1, the height H of the room is created by one and only one plastic tube 1. In another embodiments, the height H of the room may be created from plurality of plastic tubes that are attached to each other. An advantage is that smaller (shorter) tubes may be easier to transport and handle in some situations.

In one embodiment, the wall of the room comprises plurality of plastic tubes arranged concentrically to each other. Thus, the strength of the wall may be increased if needed. The concentrically arranged tubes may have at least essentially equal length, or alternatively, they are essentially of different length.

The diameter of the plastic tube 1 is selected according to the need. The outer diameter of the tube may be up to several meters, 3-5 meters for instance, or even more.

The material of the plastic tube 1 comprises thermoplastic, either as one polymer only or mixture of two or more polymers.

In one embodiment, the thermoplastic is selected from polyolefin polymers, such as polyethylene PE, HDPE for instance, polypropylene PP and polybutylene (PB) polymers.

In one embodiment, the thermoplastic is selected from polyamides (PA) and acrylonitrile butadiene styrene (ABS).

In addition to the thermoplastic, the material of the plastic tube 1 may comprise e.g. colorants, fillers, additives, processing aids, reinforcing materials etc.

The room arrangement 100 further comprises a passage 7 (shown in FIG. 2) arranged in a ceiling of the room R for allowing a person entry in said room R. In embodiments where the axial direction X of the plastic tube is arranged to create the height H of the room, the arrangement 100 comprises a cover structure 6 that is arranged to cover the room R from above and the passage 7 is arranged in the cover structure 6.

In one embodiment, the cover structure 6 is a plastic-made element that has an edge part 20 covering an upper part of the outer surface 3 of the plastic tube.

The cover structure 6 is attached to the plastic tube 1 by a watertight manner, such as by welding or gluing.

In one embodiment, such as shown in FIG. 1, a top element 15 is arranged for supporting the cover structure 6 under thereof. In one embodiment, the top element 15 is a plate-like element construed from e.g. glued laminated timber. In another embodiment, the top element 15 comprises rafters or like structure.

The passage 7 may be e.g. a simple opening having suitable dimensions and shape in the cover structure 7.

In one embodiment, the passage 7 is provided with a sleeve 8 that extends from the passage to ground level. The sleeve 8 may be e.g. a plastic tube that is attached to the cover structure 6, preferably in watertight manner by e.g. welding or gluing. The cross-section of the sleeve may be e.g. round, roundish or polygon, and its wall may be solid or hollow.

In one embodiment, the sleeve 8 is an integral part of the cover structure 6. This kind of integrated structure can be made by e.g. a rotational moulding method.

An openable cover 18 (shown in FIG. 2) can be arranged on the passage 7 or the sleeve 8 for closing thereof. In one embodiment, the openable cover 18 comprises a translucent section that allows sunlight to enter in the room R. The translucent openable cover 18 may comprise e.g. a skylight. However, it is to be noted that translucency is not always necessary feature of the openable cover.

In one embodiment, a staircase 9 is arranged in the room R. The staircase 9 extends from the room to the passage 7. In one embodiment, such as shown in FIG. 2, the staircase 9 is a spiral staircase.

The arrangement 100 comprises a floor structure. In one embodiment, the floor structure comprises a bottom element 12 made of plastic, such as plastic honeycomb or cell board. In one embodiment, the bottom element 12 is attached to the plastic tube 1 by a watertight manner, such as by welding or gluing.

In one embodiment, such as shown in FIGS. 1 and 2, at least one support element 22 is provided outside of the plastic tube 1 for supporting thereof. The support element 22 may be attached to the outer surface 3 of the plastic tube and to the bottom element 12, for instance.

In one embodiment, such as shown in FIGS. 1 and 2, the bottom element 12 is arranged in a sloping position such that e.g. water (if any) on the bottom element flows away. In one embodiment, there is a drain (not shown) arranged in the lowest point of the bottom element 12 for removing water. A discharge pump (not shown) may be connected to the drain. It is to be noted that the bottom element 12 may also be arranged essentially horizontally.

In one embodiment, such as shown in FIG. 1, joists 14 or corresponding elements are arranged on the bottom element 12, and an interior lining 10 is arranged for creating floor of the room R. The interior lining 10 may be e.g. timber, wood- or plastic-based panel, metal, stone or ceramics etc. It is to be noted that the joists and the interior lining is not always necessary, so the bottom element 12 may create the interior surface of the room R, for instance.

In one embodiment, to the inner surface 2 of the plastic tube is arranged an interior lining 10 for creating an interior wall surface of the room R. Said interior lining 10 may comprise e.g. timber, wood- or plastic-based panel, metal, stone or ceramics etc. In another embodiment, there is no interior lining 10 on the inner surface 2; instead said inner surface 2 creates the interior wall surface of the room R.

In embodiments where the wall of the plastic tube comprises the hollow 4, one or more functional elements 5 may be arranged or integrated in the hollow. The functional element 5 may be e.g. a ventilation duct, an electric cable, a communications cable or wire, a water pipeline, a drain-pipe. For instance, the ventilation duct 16 may be connected to the hollow 4. The hollow 4 may also or additionally function as a thermal insulation as such or filled with a suitable insulation material.

In one embodiment comprising at least two hollows 4, a first hollow is used for removing air form the room whereas a second hollow is used for feeding replacement air in the room.

Figure 4B:
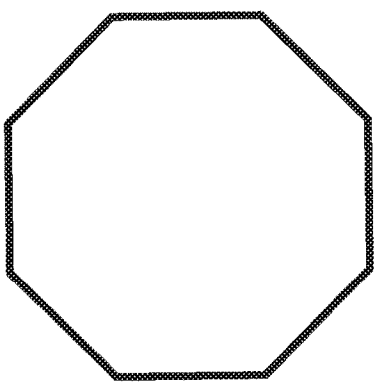
Figure 4A:
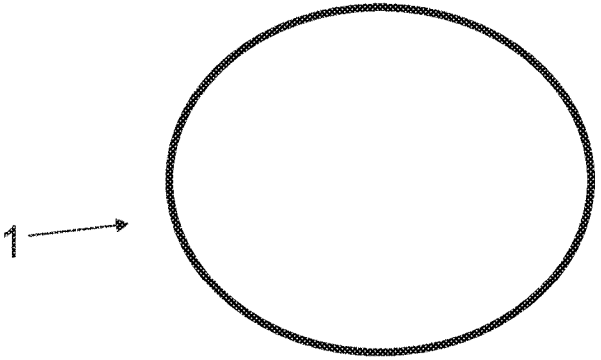

FIGS. 4*a* and 4*b* are showing further embodiments of the plastic tube.

In one embodiment, such as shown in FIGS. 1-3, the plastic tube 1 has a round cross-section.

In one embodiment, such as shown in FIG. 4*a*, the plastic tube 1 has a roundish cross-section. The term "roundish" is covering shape of e.g. an oval, an ovoid, and any combination of curved and straight sections without sharp corners.

In one embodiment, such as shown in FIG. 4*b*, the plastic tube 1 has a polygonal cross-section. The plastic tube 1 shown in FIG. 4*b* has eight sides, however, the number of sides may vary from three to numbers far beyond eight.

Figure 5:
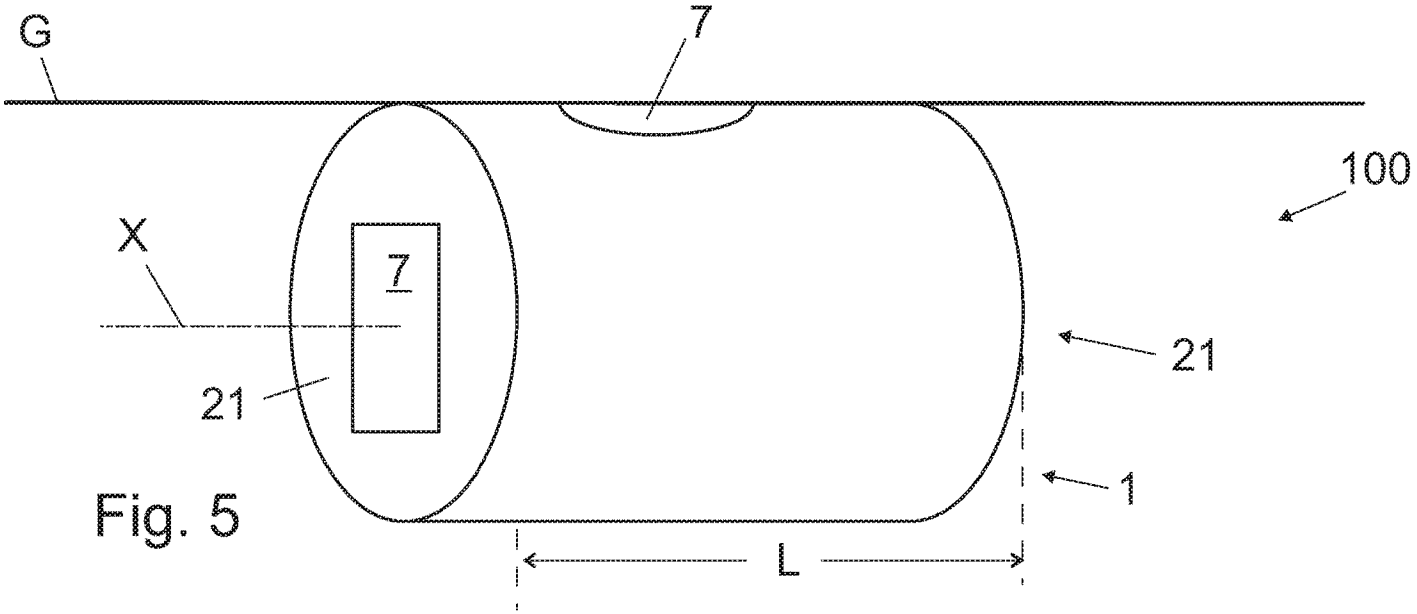
FIG. 5 is a schematic view of another arrangement.

FIG. 5 is a schematic view of another arrangement. In one embodiment, the axial direction X of the plastic tube 1 is arranged to create a length L of the room. End walls 21 are arranged to close the plastic tube. The end walls 21 are made of e.g. plastic and attached to the plastic tube, preferably in a watertight manner.

In one embodiment, the passage 7 is arranged in the wall of the plastic tube 1. In another embodiment, the passage 7 is arranged in at least one of the end walls 21. In some embodiments, such as shown in FIG. 5, there are passages 7 arranged in the wall of the plastic tube 1 and in the end wall 21.

In one embodiment, such as shown in FIG. 5, the arrangement 100 is situated so close to the ground level G, that there is no need for any sleeve.

It is to be noted here, that also in those embodiments where the axial direction X of the plastic tube is arranged to create the height H of the room, such as shown in FIGS. 1-3, there may be a passage 7 in the wall of the plastic tube 1.

In one embodiment, there is just one plastic tube 1 dimensioned to create all the length of the room. In another embodiment, there are two or more plastic tubes 1 attached successively for creating the length of the room.

In one embodiment, the axial direction X is parallel with the horizontal level. In one embodiment, the axial direction X is slightly tilted in relation to the horizontal level. This may help water (if any) on the bottom of the tube to flow away. In one embodiment, there is a drain (not shown) arranged for removing water, and a discharge pump (not shown) may be connected to the drain.

The purpose of the room arrangement 100 and the room R according to the current disclosure may have been selected among wide variety of different purposes. The room may be e.g. a sauna (such as shown in FIG. 1), a cellar, a wine cellar, a (remote) work room, a living room, a bedroom, a kitchen, a shelter for time of crisis, a storeroom, a command post, a mancave, a playroom, lobby, stairwell etc.

The arrangement 100 may comprise not only one but at least two room spaces separated by dividing walls. For instance, a work room and a toilet can be included in the arrangement.

According to an aspect, two or even more arrangements 100 may be connected to each other so that an access from one arrangement to another is enabled by passages 7 connected to each other directly or by sleeve-like extensions.

In one embodiment, the room arrangement 100 is manufactured such that it includes at least most of interior objects, functional elements, the cover structure and the bottom element as well as the passage etc. assembled already at its production plant. Then only minor construction works is needed on a building site.

The invention is not limited solely to the embodiments described above, but instead many variations are possible within the scope of the inventive concept defined by the claims below. Within the scope of the inventive concept the attributes of different embodiments and applications can be used in conjunction with or replace the attributes of another embodiment or application.

The drawings and the related description are only intended to illustrate the idea of the invention. The invention may vary in detail within the scope of the inventive idea defined in the following claims.

REFERENCE SYMBOLS

1 plastic tube
2 inner surface
3 outer surface
4 hollow
5 functional element
6 cover structure
7 passage
8 sleeve
9 staircase
10 interior lining
11 interior object
12 bottom element
13 thermal insulation
14 joist

15 top element
16 ventilation duct
17 backfill
18 openable cover
19 dividing wall
20 edge part
21 end wall
22 support element
100 arrangement
H height of room
L length of room
X axial direction
R room

The invention claimed is:

1. An underground room arrangement, comprising:

a structure surrounding a room, the structure comprising a plastic tube and plastic end walls, wherein the plastic end walls are arranged to close the plastic tube so that inner surfaces of the plastic tube and the plastic end walls are towards the room;

wherein a wall of the plastic tube comprises a hollow;

wherein the hollow is a spiral hollow spiraling in the wall in an axial direction of the plastic tube;

wherein the wall of the plastic tube is construed from at least one spiraling hollow plastic pipe; and wherein the at least one spiraling hollow plastic pipe has a rectangular cross section, wherein a first side of the rectangular cross section of the at least one spiraling hollow plastic pipe towards the room forms an inner surface of the plastic tube;

a second side, opposite the first side, of the rectangular cross section of the at least one spiraling hollow plastic pipe away from the room forms an outer surface of the plastic tube; and the at least one spiraling hollow plastic pipe spirals in the wall in the axial direction of the plastic tube spiraling between the first and second sides of the rectangular cross section.

2. The underground room arrangement as claimed in claim 1, wherein a dimension of the room in the axial direction of the plastic tube is created by one and only one plastic tube.

3. The underground room arrangement as claimed in claim 2, wherein the axial direction of the plastic tube is arranged to create a height of the room, wherein one of the plastic end walls is arranged as a cover structure to cover the room from above, wherein another of the plastic end walls is arranged as a bottom element, and wherein the underground room arrangement further comprises a passage arranged in at least one of: the cover structure and the wall of the plastic tube.

4. The underground room arrangement as claimed in claim 3, wherein the passage is provided with a sleeve extending away from the room.

5. The underground room arrangement as claimed in claim 3, further comprising a staircase arranged to extend from the room to the passage.

6. The underground room arrangement as claimed in claim 1, further comprising a functional element arranged or integrated in the hollow.

7. The underground room arrangement as claimed in claim 6, wherein the functional element comprises at least one of the following elements: a ventilation duct, an electric cable, a water pipeline, and a drainpipe.

8. The underground room arrangement as claimed in claim 1, wherein the axial direction of the plastic tube is arranged to create a length of the room, wherein the plastic tube is arranged to cover the room from above, below and two sides, and wherein the underground room arrangement further comprises a passage arranged in at least one of: the wall of the plastic tube and one of the end walls.

9. The underground room arrangement as claimed in claim 1, wherein the material of the plastic tube comprises thermoplastic.

10. The underground room arrangement as claimed in claim 1, wherein the plastic tube has a circular or a polygonal cross-section.

11. The underground room arrangement as claimed in claim 1, wherein the plastic end walls are attached to the plastic tube by a watertight manner.

12. The underground room arrangement as claimed in claim 1, wherein the room is at least one of: a sauna, a cellar, a (remote) work room, a living room, a bedroom, a kitchen, a shelter for time of crisis, a storeroom, a command post, a mancave, a playroom, a lobby, and a stairwell.

* * * * *